United States Patent [19]

Held

[11] 3,977,330

[45] Aug. 31, 1976

[54] WARHEAD CONSTRUCTION HAVING AN ELECTRICAL IGNITION DEVICE

[75] Inventor: Manfred Held, Kuhbach, Germany

[73] Assignee: Messerschmitt-Bölkow-Blohm GmbH, Germany

[22] Filed: Feb. 20, 1974

[21] Appl. No.: 444,184

[30] Foreign Application Priority Data

Feb. 23, 1973 Germany ..... 2308912

[52] U.S. Cl. ..... 102/70.2 R; 102/56 SC; 102/70.2 GA

[51] Int. Cl.[2] ..... F42C 11/00; F42B 13/10

[58] Field of Search ..... 102/70.2 R, 70.2 GA, 102/75, 56 SC

[56] References Cited

UNITED STATES PATENTS

| | | | |
|---|---|---|---|
| 2,485,887 | 10/1949 | Jordan | 102/70.2 R |
| 3,145,656 | 8/1964 | Cook et al. | 102/56 SC |
| 3,675,579 | 7/1972 | Min | 102/70.2 R |
| 3,788,225 | 1/1974 | Held | 102/70.2 R |

*Primary Examiner*—Charles T. Jordan
*Attorney, Agent, or Firm*—McGlew and Tuttle

[57] ABSTRACT

A warhead includes an outer casing and an explosive charge substantially filling the casing and the warhead has the usual streamlined tip with a target contact or impact trip element. The trailing end of the warhead is closed by a cover over a pot which contains an electronic ignition device. The explosive charge in the warhead is provided with a central bore which extends inwardly from its trailing end toward the tip and the bore is filled with a series of ignition elements or an ignition train which includes a first element which is centrally located along the longitudinal length of the bore and connected to the electronic ignition device. The train of ignition elements are capable of being set in a safety position and they may be armed before or during flight of the warhead by an arming mechanism which places them in an operating position. Ignition is effected from the electronic ignition device to the first member in the ignition train which is arranged to actuate a piezoelectric element in response to an impulse from the electronic ignition device to set off a series of delayed charges and detonating charges arranged at spaced locations in each direction along the length from the first actuating member of the train.

5 Claims, 1 Drawing Figure

WARHEAD CONSTRUCTION HAVING AN ELECTRICAL IGNITION DEVICE

BACKGROUND OF THE INVENTION

1. Field of the Invention

This invention relates in general to the construction of warheads and, in particular, to a new and useful warhead construction and electrical ignition system for detonating an explosive charge in the warhead which includes an ignition train arranged along the length of a bore centrally positioned within the explosive charge.

2. Description of the Prior Art

As is well known, a warhead used against a bunker, ship or similar target produces its maximum destructive effect when the explosive charge is set off just after the hit wall has been penetrated. Such a delayed detonation can be obtained by an ignition device having a series of igniting charges producing a time delay before the main explosive charge is ignited.

In the known warheads, similar ignition devices are mounted in their entirety in or on the warhead bottom. Such a design proves to be very unsatisfactory sometimes. The drawbacks become most evident if the warhead impinges upon a particularly massive structure such as, for example, a ship wall in the zone of a transverse bracing, or a bunker wall in the zone of a crossbeam. In such cases, only the thick-walled ogive of the head provided with special cutting edges for attacking and penetrating obstacles resists the stresses produced by the impact. In contrast thereto, the shell of the warhead which, in favor of maximizing the content of explosives, is dimensioned for an impact only on target structures having a normal resistance, and which sometimes is even weakened by integrated sections forming projectiles, undergoes deformations. The deformation of the shell due to the impact is frequently so extensive that the bottom of the warhead secured to the shell is torn away along with the entire ignition device before the latter is able to set off the explosive charge.

SUMMARY OF THE INVENTION

The present invention ensures, in a simple manner, that an ignition device will initiate the detonation of the explosive charge of a warhead even in cases where the shell is deformed by an impact on the target so that the bottom of the warhead is torn off.

In accordance with the invention, the ignition electronics are located in the bottom of the warhead or in a pot adjacent the bottom, and the ignition train is arranged in a bore extending from the warhead bottom or the adjacent pot into the explosive charge.

The inventive arrangement can be easily realized. The arrangement makes certain that a time-delayed ignition of the explosive charge takes place even in cases in which the bottom and perhaps also the adjacent pot are torn off the warhead penetrating into the target. The warhead bottom or the adjacent pot accommodates only the ignition electronics, and this is the part of the ignitiono device which is of no further importance after the impact on the target. From the instance of the impact, the ignition train alone is responsible for the delayed initiation of the explosion and, in accordance with the invention, this train remains in its original place even if the bottom or the adjacent pot is torn away.

The last-mentioned advantage is due to the inventive design which makes it possible to dispense with a strong connection between the warhead bottom and the ignition train, and instead, the ignition train is separated from the ignition electronics and is mounted in a bore provided in the explosive charge. Among the numerous possible arrangements, the following ignition train, for example, is particularly recommendable for its simplicity and reliability and comprises:

a. a priming cap operatively connected to the ignition electronics;
b. a pyrotechnic delay charge;
c. a detonator;
d. a piezoelectric generator;
e. at least one additional priming cap;
f. at least one additional detonator adapted to be pivoted or shifted for putting the train into a safety position;
g. at least one transfer charge; and
h. at least one booster charge.

The train is mounted in a bushing to be inserted into a bore which is provided in the explosive charge and preferably lined with an aluminum foil or the like.

If the ignition electronics is located in a pot adjacent the bottom of the warhead, the pot is connected, in accordance with the invention, only to the bushing containing the ignition train and is secured in such a manner that, under stress, the connection breaks immediately. Such a connection between the bushing and the pot may be constituted, for example, by screws which are of correspondingly small dimensions or provided with rated break points.

The ignition train is reset from a safety into a ready position by means of a power cylinder unit which operates a draw rod associated with swing segments or shifting elements and includes a level actuated by the piston rod and acting on the draw rod. Therefore, it is useful to locate both the power cylinder unit and the ignition electronics in the bottom of the warhead or in a pot adjacent thereto and to mount the draw rod with the lever and the swing segments or shifting elements as well as the ignition train within a bore provided in the explosive charge or in a bushing fixed in the bore, and also to guide the lever connecting the piston rod to the draw rod in a groove provided in the end portion of the piston rod and open toward the ignition train. As soon as the pot, for any reason, becomes detached from the bushing, the lever is removed from the groove and, consequently, the part of the safety device bound to the pot cannot entrain the ignition train or any member of this train.

Accordingly, it is an object of the invention to provide an improved warhead construction which includes an explosive charge which, for example, is actuated by a trip mechanism which is set off, for example, by contact or inertial impact at the target and which includes an explosive charge therein having an elongated bore extending longitudinally therethrough from the trailing or bottom end and which includes a closed bottom carrying an ignition system with electronic controls located adjacent the bottom and with an ignition train arranged along the length of the bore in the explosive charge in a position in which it will not be deformed before ignition of the explosive charge, and which advantageously includes a delayed ignition system and means for setting the ignition elements in a saftey position which is preferably controlled by a control arranged in the bottom of the warhead.

A further object of the invention is to provide a warhead construction which is simple indesign, rugged in construction and economical to manufacture.

For an understanding of the principles of the invention, reference is made to the following description of a typical embodiment thereof as illustrated in the accompanying drawing.

DESCRIPTION OF A PREFERRED EMBODIMENT

Figure 1:
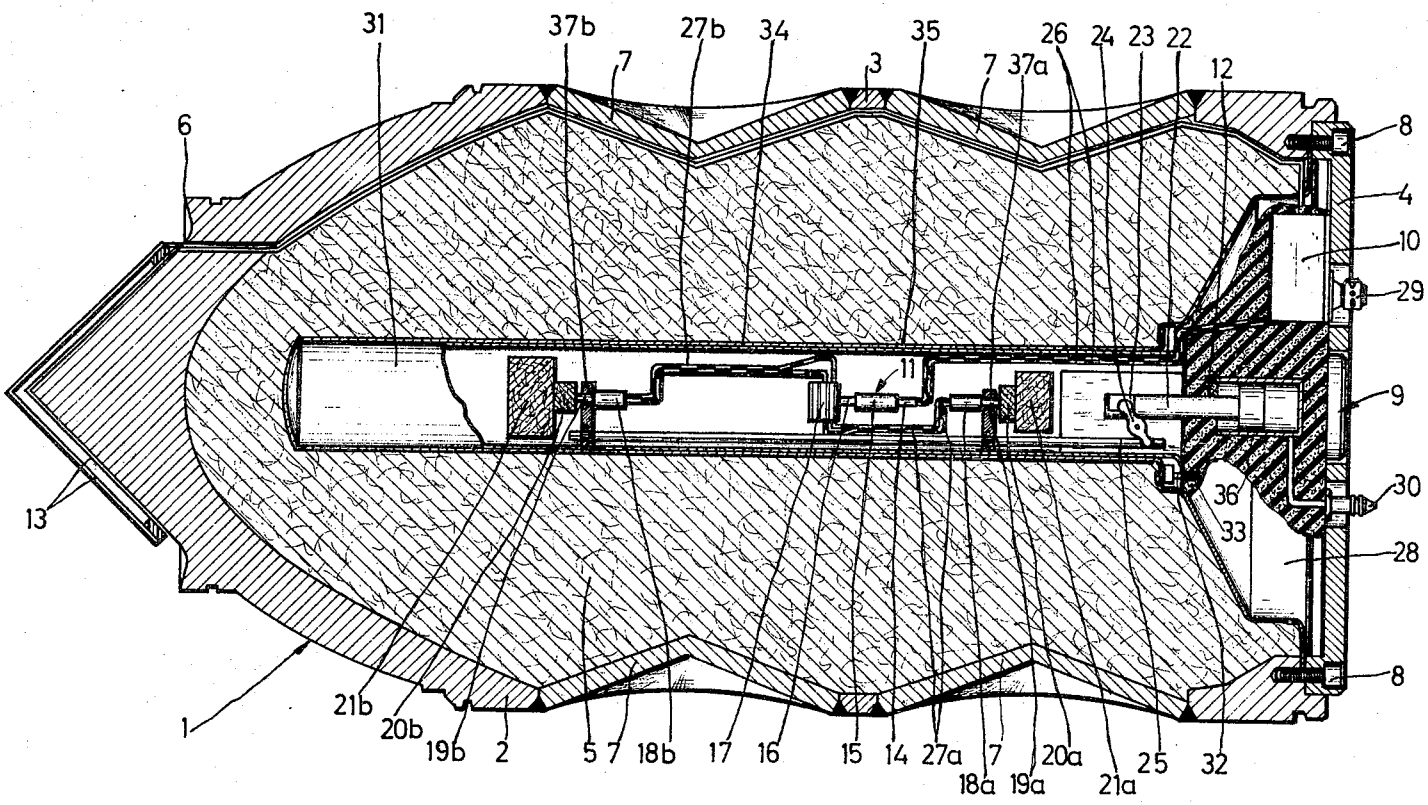
FIG. 1 is a longitudinal sectional view of a warhead constructed in accordance with the invention.

Referring to the drawing in particular, the invention embodiment therein, comprises a warhead, generally designated 1, which for example, is used in action against ships, and which includes an outer casing having a front portion or ogive 2, and a sidewall portion or shell 3, and a trailing portion or bottom 4. A major portion of the warhead is filled with an explosive charge 5. Ogive 2 is thick-walled and provided with a cutting edge 6. The rellatively thin-walled shell 3 includes integrated sections 7 forming projectiles or hollow charge thorn elements. The bottom 4 of the warhead is secured to the enlarged end portion of shell 3 by means of screws or bolts 8.

In accordance with a feature of the invention, an electrical ignition device 9 is mounted within the warhead adjacent the bottom and may in fact be affixed to bottom 4. Ignition device 9 contains elements for providing a controlled electric pulse for setting off an explosive charge 5 through an ignition train 11 which, in accordance with a main feature of the invention, is located at a spaced location from bottom 4 well within the bore 35 defined longitudinally through the explosive charge 5 from the bottom end toward the forward end. The ignition device 9 and ignition train 11 ensure that explosive charge 5 of warhead 1 will not be set off until the warhead has pierced the hit wall of the ship or other target.

When the warhead impacts at a target, an impact contact 13 mounted at the front of the warhead on ogive 2 is actuated, and it is connected to the ignition electronics 10 which in turn is connected through a relatively long connecting cable 26 to ignition train 11 which is spaced inwardly from the bottom by a considerable distance.

Ignition train 11 includes a safety device, generally designated 12, which ensures that the train will not be set off except when it is present. When imapct contact 13 is actuated, a short circuit is produced thereby, which delivers an actuation pulse to the ignition electronics 10 which in turn delivers a voltage impulse to the first or initial member of the ignition train 11.

In the embodiment illustrated, ignition train 11 comprises, for example, a priming cap 14 which is responsive to the voltage impulse delivered by the electronics device 10, a pyrotechnic delay charge 15, a detonator 16, a piezoelectric generator 17, two additional electrical priming caps 18*a* and 18*b*, two additional detonators 19*a* and 19*b* which are arranged so that they are movable by the safety device 12 from their safety position into a ready position. The ignition train may also include two transfer charges 20*a* and 20*b*, and two booster charges 21*a* and 21*b*, and these elements are all spaced in respective directions away from the delay charge 15 and the detonator 16 and piezoelectric element 17.

The safety device 12 comprises a power cylinder unit 36 having a piston rod 22 movable therein, which is provided with a groove 23 open toward the ignition train 11. A lever 24 is pivotally mounted adjacent piston rod 22 and one end is guided in a groove 23. The opposite end of the lever 24 is connected to an elongated draw rod 25 so that movement of the piston rod 22 will move the lever and shift the longitudinal position of the rod 25. The construction includes two swing segments 37*a* and 37*b* which are located at longitudinal spaced relationship and which are connected to rod 25 and which act upon detonators 19*a* and 19*b*. The individual elements of the ignition train are connected by electrical lines 27*a* and 27*b* and which lead in respectife longitiudinal directions away from the piezoelectric generator 17 to the priming caps 18*a* and 18*b*.

Because the ignition electronics 10 is located along with the power cylinder unit 36 of the safety device 12 in a pot 28 disposed directly adjacent bottom 4 of the warhead, it is in a position which is somewhat protected against impact but, nevertheless, does not intefere with the operation of the remaining ignition train 11. A plug socket 29 for the power supply of ignition electronics 10 and a connection 30 of power cylinder unit 36 for the supply of working fluid extend from the respective devices outwardly through the bottom plate 4.

Pot 28 is not connected to bottom 4 of the warhead, and on its opposite end, it is connected to a bushing 31 by screws 33 which have rated break points 32. Bushing 31 is inserted in bore 35 extending in explosive charge 5 from pot 28 toward ogive 2 and it is lined, for example, with an aluminum foil 34. Ignition train 11 is mounted in the bushing 31. The lever 24, draw rod 25, and the swing segments 37*a* and 37*b* of the safety device 12 are also mounted in the bushing 31. The end portion of piston rod 22 comrpising groove 23 projects into bushing 31.

The operation of the warhead is as follows:

At the instant warhead 1 impinges upon a target, such as a ship wall, impact contact 13 provided on ogive 2 is closed. In consequence, ignition electronics 10 deliver a voltage pulse to the first member of ignition train 11, priming cap 14, which reacts instantly, and ignites delay charge 15. After the expiration of the predetermined time, delay charge 15 lights detonator 16. The shock wave issuing therefrom charges the ceramics of piezoelectric generator 17. The transmitted charge energy actuates priming caps 18*a*, 18*b*. Caps 18*a*, 18*b* ignite detonators 19*a*, 19*b* which, upon firing of the missile, are swung from their safety position into their ready position. The detonators ignite transfer charges 20*a*, 20*b* and booster charges 21*a*, 21*b* and thereby, explosive charge 5 simultaneously at two places. The delayed initiation of explosive charge 5 is assured even if, at the impact on the target, warhead 1 is deformed with the result that bottom 4 is torn off. That is, in spite of this disruption, ignition train 11 which, after the closing of impact contact 13, operates independently continues to keep its original position within the explosive charge. This applies even under particularly strong deformation forces which separate not only bottom 4, but also pot 28 from the shell. In such a case, screws 23, securing pot 28 to bushing 31, break at rated points 32, and lever 24 disengages from piston rod 22 of safety device 12.

While a specific embodiment of the invention has been shown and described in detail to illustrate the application of the principles of the inventions, it will be understood that the invention may be embodied otherwise without departing from such principles.

What is claimed is:

1. An electrical ignition device for the explosive charge of a warhead, comprising a warhead having an explosive charge therein with a central bore, a trip element effective upon contact with target, electronic circuitry connected to said trip element for actuartion thereby to deliver a voltage impulse, an ignition train connected to said circuitry and having an operative position and a safety position and including a first member responsive to the voltage impulse and an end member connected to said first member and the explosive charge and effective with the ignition train in its ready position to set off the explosive charge, and a delay member connected between said first member and said end member for actuating said end member after a time interval starting at the response of the first member and predetermined by said delay member, said warhead having a bottom at its trailing end, the electronic circuitry being located inside said warhead adjacent said bottom, and said ignition train all being mounted in the bore of said explosive charge at a location extending inwardly from said warhead bottom, and an elongated bushing arranged in the bore of said explosive charge, said bushing having a lining of aluminum.

2. An electrical ignition device for the explosive charge of a warhead, comprising a warhead having an explosive charge therein with a central bore, a trip element effective upon contact with a target, electronic circuitry connected to said trip element for actuation thereby to deliver a voltage impulse, an ignition train connected to said circuitry and having an operative position and a safety position and including a first member responsive to the voltage impulse and an end member connected to said first member and the explosive charge and effective with the ignition train in its ready position to set off the explosive charge, and a delay member connected between said first member and said end member for actuating said and member after a time interval starting at the response of the first member and predetermined by said delay member, said warhead having a bottom at its trailing end, the electronic circuitry being located inside said warhead adjacent said bottom, and said ignition train all being mounted in the bore of said explosive charge at a location extending inwardly from said warhead bottom, a pot in said warhead adjacent said bottom and a bushing connected into the bottom of said pot and extending longitudinally along the bore of said explosive charge and means interconnecting said pot and said bushing providing a preset breaking joint which breaks under a predetermined stress.

3. An electrical ignition device for the explosive charge of a warhead, comprising a warhead having an explosive charge therein with a central bore, a trip element effective upon contact with a target, electonic circuitry connected to said trip element for actuation thereby to deliver a voltage impulse, an ignition train connected to said circuitry and having an operative position and a safety position and including a first member responsive to the voltage impulse and an end member connected to said first member and the explosive charge and effective with the ignition train in its ready position to set off the explosive charge, and a delay member connected between said first member and said end member for actuating said end member after a time interval starting at the response of the first member and predetermined by said delay member, said warhead having a bottom at its trailing end, the electronic circuitry being located inside said warhead adjacent said bottom, and said ignition train all being mounted in the bore of said explosive charge at a location extending inwardly from said warhead bottom, a safety device for positioning said ignition train in a safety position including a power cylinder having a piston rod movable backwardly and forwardly therein, a lever pivotally mounted inside said warhead and connected to said piston rod and being movable thereby, a draw rod connected to said lever and movable by actuation of said lever and at least one swing unit connected to said draw rod being movable thereby to shift an ignition train element between the safety and actuation positions, said safety device and said electronic circuit being connected to said bottom, said draw rod extending outwardly from said bottom for actuating said shifting elements and being located in the bore of the explosive charge.

4. A warhead construction, comprising an outer casing having a contact tip at its forward end and a closed bottom at its opposite trailing end, an explosive charge in said casing having a longitudinally extending substantially centrally positioned bore extending inwardly from the end thereof adjacent said bottom, electronic ignition means in said casing alongside said bottom, an ignition train including a first actuation member connected to said ignition means and actuatable thereby and all located in said bore intermediate the length of said ignition train and spaced a considerable distance away from said electronic ignition means, said train including a plurality of ignitable elements connected to said first member and spaced along the bore and providing successively actuated charges providing a delayed ignition of said explosive charge, said ignitable elements being movable between a safety position and an actuation position, and means for moving said safety elements from a safety position into an actuation position, including a fluid cylinder mounted on said bottom having a piston slidable therein and a connection on said bottom for supplying fluid pressure to said cylinder to arm said ignition circuit.

5. An electrical ignition device for the explosive charge of a warhead, comprising a warhead having an explosive charge therein with a central bore, a trip element effective upon contact with a target, electronic circuitry connected to said trip element for actuation thereby to deliver a voltage impulse, an ignition train connected to said circuitry and having an operative position and a safety position and including a first member responsive to the voltage impulse and an end member connected to said first member and the explosive charge and effective with the ignition train in its ready position to set off the explosive charge, and a delay member connected between said first member and said end member for actuating said end member after a time interval starting at the response of the first member and predetermined by said delay member, said warhead having a bottom at its trailing end, the electronic circuitry being located inside said warhead adjacent said bottom, and said ignition train all being mounted in the bore of said explosive charge at a location extending inwardly from said warhead bottom.

* * * * *